US009207601B2

(12) United States Patent
Kubota

(10) Patent No.: US 9,207,601 B2
(45) Date of Patent: Dec. 8, 2015

(54) CONTROL METHOD, FIXING DEVICE AND IMAGE FORMING APPARATUS INCORPORATING SAME

(71) Applicant: Keisuke Kubota, Kanagawa (JP)

(72) Inventor: Keisuke Kubota, Kanagawa (JP)

(73) Assignee: Ricoh Company Ltd., Tokyo (JP)

( * ) Notice: Subject to any disclaimer, the term of this patent is extended or adjusted under 35 U.S.C. 154(b) by 1 day.

(21) Appl. No.: 13/942,787

(22) Filed: Jul. 16, 2013

(65) Prior Publication Data

US 2014/0029991 A1 Jan. 30, 2014

(30) Foreign Application Priority Data

Jul. 26, 2012 (JP) ..... 2012-166203
Mar. 29, 2013 (JP) ..... 2013-072615

(51) Int. Cl.
*G03G 15/20* (2006.01)
*G03G 15/16* (2006.01)

(52) U.S. Cl.
CPC ..... *G03G 15/2064* (2013.01); *G03G 15/2025* (2013.01); *G03G 15/161* (2013.01); *G03G 15/2075* (2013.01); *G03G 2215/0129* (2013.01); *G03G 2215/1695* (2013.01); *G03G 2215/2032* (2013.01)

(58) Field of Classification Search
CPC ..... G03G 15/20
USPC ..... 399/327
See application file for complete search history.

(56) References Cited

U.S. PATENT DOCUMENTS 4,557,588 A * 12/1985 Tomosada ..... 399/352
5,168,314 A * 12/1992 Gunji et al. ..... 399/327
5,649,130 A * 7/1997 Nakajima et al. ..... 399/327
5,848,341 A * 12/1998 Watanabe ..... 399/352
5,970,298 A * 10/1999 Seki et al. ..... 399/327
5,978,640 A * 11/1999 Segawa ..... 399/327
6,226,475 B1 * 5/2001 Kabumoto et al. ..... 399/107
6,305,636 B1 * 10/2001 Satoh et al. ..... 242/538.2
6,396,410 B1 * 5/2002 Kabumoto et al. ..... 340/815.65
6,915,098 B2 * 7/2005 Matsumoto ..... 399/327
7,239,838 B2 * 7/2007 Sato et al. ..... 399/329

(Continued)

FOREIGN PATENT DOCUMENTS

JP 52-122133 10/1977
JP 2002-258657 9/2002

(Continued)

*Primary Examiner* — Clayton E Laballe
*Assistant Examiner* — Kevin Butler
(74) *Attorney, Agent, or Firm* — Harness, Dickey & Pierce, P.L.C.

(57) ABSTRACT

A fixing device includes a rotary fuser member, a rotary pressure member, and a cleaning system. The rotary fuser member is subjected to heating. The rotary pressure member is disposed opposite the fuser member. The fuser member and the pressure member are pressed against each other to form a fixing nip therebetween. The cleaning system is disposed adjacent to the pressure member to clean the pressure member, and includes a cleaning web, a web supply mechanism, and a controller. The cleaning web is disposed in contact with the pressure member to wipe the pressure member. The web supply mechanism is operatively connected to the cleaning web to supply a new, unused portion of the cleaning web to the pressure member. The controller is operatively connected to the web supply mechanism to control a web supply amount by which the cleaning web is supplied to the pressure member.

8 Claims, 6 Drawing Sheets

(56) References Cited

U.S. PATENT DOCUMENTS

| | | | | |
|---|---|---|---|---|
| 7,349,659 | B2 * | 3/2008 | Kakishima et al. | 399/327 |
| 7,454,151 | B2 * | 11/2008 | Satoh et al. | 399/69 |
| 7,756,435 | B2 * | 7/2010 | Nakano | 399/71 |
| 8,027,603 | B2 * | 9/2011 | Fromm | 399/45 |
| 8,693,932 | B2 * | 4/2014 | Okamoto | 399/327 |
| 2001/0043825 | A1 * | 11/2001 | Kim | 399/307 |
| 2012/0195653 | A1 * | 8/2012 | Sasaki | 399/327 |
| 2012/0219335 | A1 * | 8/2012 | Kubota | 399/327 |
| 2013/0045031 | A1 * | 2/2013 | Nagata et al. | 399/327 |
| 2014/0029991 | A1 * | 1/2014 | Kubota | 399/327 |

FOREIGN PATENT DOCUMENTS

| | | |
|---|---|---|
| JP | 2005-024619 | 1/2005 |
| JP | 2008-040053 | 2/2008 |
| JP | 2012-155067 | 8/2012 |
| JP | 2012-177863 | 9/2012 |
| JP | 2013-029575 | 2/2013 |
| JP | 2013-041087 | 2/2013 |

* cited by examiner

CONTROL METHOD, FIXING DEVICE AND IMAGE FORMING APPARATUS INCORPORATING SAME

CROSS-REFERENCE TO RELATED APPLICATIONS

This patent application claims priority pursuant to 35 U.S.C. §119 to Japanese Patent Application Nos. 2012-166203 and 2013-072615, filed on Jul. 26, 2012 and Mar. 29, 2013, respectively, the entire disclosure of each of which is hereby incorporated by reference herein.

BACKGROUND

1. Technical Field

The present invention relates to a control method, a fixing device, and an image forming apparatus incorporating the same.

2. Background Art

Fixing devices are employed in electrophotographic image forming apparatuses, such as a photocopier, facsimile machine, printer, plotter, or multifunctional machine incorporating several of these features, wherein an image formed of toner particles is fixed in place with on a recording medium such as a sheet of paper.

Among various types of fixing devices known in the art, pressure-assisted thermal fixing devices are widely used. This type of fixing device employs a pair of opposed rotary members, such as cylindrical rollers and endless, looped belts, one being a fuser member subjected to heating, for example, with a halogen heater, and the other being a pressure member pressed against the fuser member to form a fixing nip therebetween, through which the recording medium is conveyed under heat and pressure to fix a toner image thereon.

One problem associated with the fixing device depicted above is undesirable transfer of toner particles from the recording medium due to improper heating of the toner image at the fixing nip, a phenomenon generally referred to as "toner offset". Toner offset takes place where adhesion between the fuser member and the toner image exceeds adhesion between the recording medium and the toner image, causing a small portion of toner, which should ideally be fixed on the recording medium, to transfer from the recording medium to an adjoining surface of the fixing member.

Two types of toner offset are known: cold offset and hot offset.

Cold offset occurs where the toner image fuses only superficially due to insufficient heating at the fixing nip, leaving an inner portion of the toner layer in a loose, unfused state, which can partially crush up and eventually migrate to the fixing member. Incomplete fixing can also result in image defects as the toner image rubs off readily from the resultant print. Use of toner with a small particle size, which is becoming popular to meet high-quality requirements of modern imaging equipment, can aggravate cold offset, where small toner particles, as opposed to coarse, pulverized toner particles, lodge in microscopic pits on the printed surface of the recording medium, making it difficult to heat and fuse the toner image evenly and sufficiently.

Hot offset, on the other hand, occurs where excessive heating at the fixing nip affects viscoelasticity of the toner image being fused, so that the toner exhibits an excessively high adhesion to the fuser member that exceeds a cohesive force of toner particles, resulting in partial migration of toner to the fuser member.

Not surprisingly, toner offset detracts from image quality not only due to a lack of toner falling off from the recording medium, but also because the resultant print is susceptible to soiling where offset toner, once transferred from the recording medium to the fixing member, is again transferred from the fixing member to another recording medium that enters the fixing nip subsequent to the foregoing recording medium.

Various techniques have been proposed to clean the fixing member of offset toner and other adherent contaminants in the fixing device.

For example, one known fixing device employs a cleaning web, such as an elongated strip of unwoven fabric, to clean a rotary fuser member. The cleaning web is held against the fuser member to wipe offset toner off as the fuser member rotates during operation of the fixing device. For maintaining effective cleaning performance, a web supply mechanism may be provided to supply a new, unused portion of the cleaning web to the fuser member, which prevents escape of offset toner through a minute gap between the cleaning web and the fuser member.

Another, more sophisticated method includes a cleaning system that controls an amount by which the cleaning web is supplied to the fuser member according to image data from which a toner image is produced. The capability to control cleaning web supply allows for reducing maintenance costs and efforts, while obviating an unnecessary, superfluous supply of cleaning web, which would otherwise result in a significant amount of waste material that is detrimental to the environment.

The web-based cleaning system in which the cleaning web is applied to the fuser member is efficient in that it can clean the surface of the fuser member where the offset toner originally builds up. Unfortunately, however, this approach also has drawbacks. One drawback is that direct, sliding contact between the cleaning web and the fuser member causes damage to the surface of the fuser member, causing artifacts, such as vertical streaks, appearing in the resultant print. Another drawback is that the cleaning web cannot remove soiling from the pressure member to which a substantial amount of offset toner may flow from the fuser member, particularly where the fuser member is positioned vertically above the pressure member.

To counteract the problem, one approach is to apply the cleaning web to the pressure member, instead of the fuser member. For example, a fixing device has been proposed in which a cleaning web is position to contact a rotary pressure member from below to clean the pressure member. Cleaning the pressure member in turn maintains the fuser member clean of soiling where offset toner constantly transfers from the fuser member to the pressure member through the fixing nip. Moreover, positioning the cleaning web vertically below the pressure member effectively prevents offset toner from falling off the pressure member to soil the surrounding structure.

BRIEF SUMMARY

Exemplary aspects of the present invention are put forward in view of the above-described circumstances, and provide a novel fixing device.

In one exemplary embodiment, the fixing device includes a rotary fuser member, a rotary pressure member, and a cleaning system. The rotary fuser member is subjected to heating. The rotary pressure member is disposed opposite the fuser member. The fuser member and the pressure member are pressed against each other to form a fixing nip therebetween, through which a recording medium is conveyed in a conveyance direction to fix a toner image thereon. The cleaning system is disposed adjacent to the pressure member to clean the pressure member, and includes a cleaning web, a web supply mechanism, and a controller. The cleaning web is disposed in contact with the pressure member to wipe the pressure member. The web supply mechanism is operatively connected to the cleaning web to supply a new, unused portion of the cleaning web to the pressure member. The controller is operatively connected to the web supply mechanism to control a web supply amount by which the cleaning web is supplied to the pressure member. The controller adjusts the web supply amount depending on a circumferential, rotational distance traveled by the pressure member in direct contact with the fuser member, and an occurrence rate of isolated pixels in image data from which the toner image is produced.

Other exemplary aspects of the present invention are put forward in view of the above-described circumstances, and provide a novel image forming apparatus incorporating a fixing device.

Still other exemplary aspects of the present invention are put forward in view of the above-described circumstances, and provide a novel control method.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
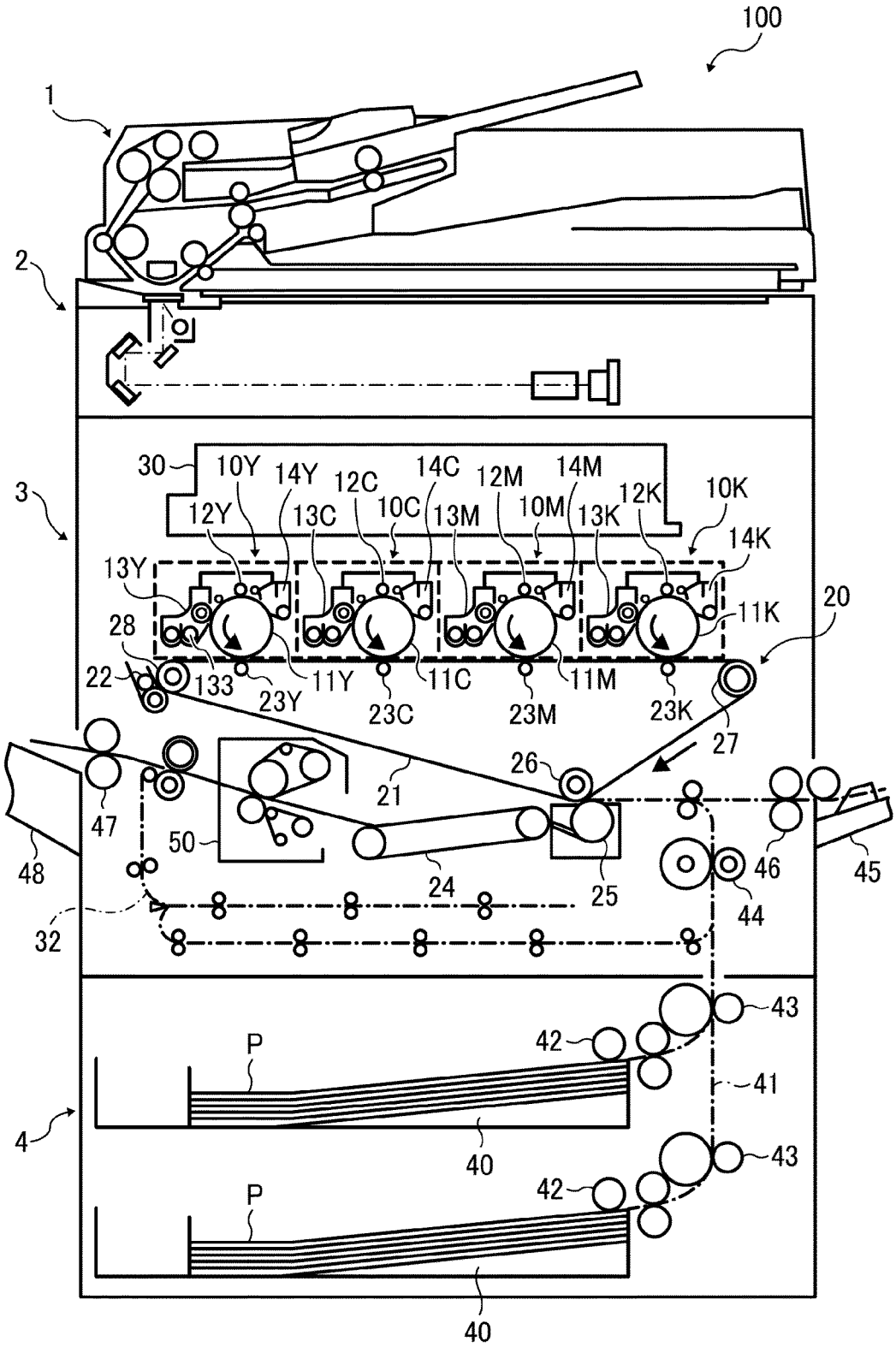
FIG. 1 is a schematic view of an image forming apparatus according to one or more embodiments of this patent specification.

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views, exemplary embodiments of the present patent application are described.

FIG. 1 is a schematic view of an image forming apparatus 100 according to one or more embodiments of this patent specification.

As shown in FIG. 1, the image forming apparatus 100 is configured as an electrophotographic copier that reproduces an image from image data obtained from an original document, including an automatic document feeder (ADF) 1 located atop the apparatus 100 to convey the original document; an image scanner 2 located below the ADF 1 to capture image data from the original document; a printing unit 3 located at the center of the apparatus 100 to form an image from the image data; and a sheet feeding unit 4 at the bottom of the apparatus 100 to supply a recording medium P, such as a sheet of paper, to the printing unit 3.

The printing unit 3 comprises a tandem color printer, including four imaging stations 10Y, 10C, 10M, and 10K (collectively refereed to as "imaging stations 10"), each configured to form an image with toner particles of a particular primary color, as designated by the suffixes "C" for cyan, "M" for magenta, "Y" for yellow, and "K" for black.

Specifically, each imaging station 10 includes a drum-shaped photoconductor 11 rotatable in a given rotational direction counterclockwise in the drawing. The photoconductor 11 has its outer, photoconductive surface surrounded by various pieces of imaging equipment, such as a charging device 12 to uniformly charge the photoconductive surface, a development device 13 to develop an electrostatic latent image into a visible, toner image, and a cleaning device 14 to clean the photoconductive surface after transfer of the toner image. The imaging station 10 may be configured as a removable process cartridge in which the photoconductor 11 and its associated imaging equipment are supported together on a single supporting structure for removable installation in the printing unit 3.

Disposed above the imaging stations 10 is an exposure device 30 that irradiates the photoconductive surface with light to create an electrostatic latent image according to image data. The exposure device 30 may be configured as a laser device including various pieces of optical equipment, such as a laser source, a polygon mirror, an f–θ lens, a reflection mirror, and the like, from which a laser beam is directed toward the photoconductor 11 rotating in the rotational direction to scan the photoconductive surface in a given scanning direction.

Also included in the printing unit 3 are a transfer device 20 disposed immediately below the imaging stations 10 to transfer the toner image from the photoconductive surface to the recording sheet P, and a fixing device 50 disposed adjacent to the transfer device 20 to fix the toner image in place on the recording sheet P.

Specifically, the transfer device 20 includes an intermediate transfer belt 21 entrained around a plurality of rollers, including a transfer backup roller 26 and other belt-support rollers 27 and 28, for rotation in a given rotational direction clockwise in the drawing. Four electrically biased, primary transfer rollers 23Y, 23C, 23M, and 23K are disposed opposite the photoconductors 11Y, 11C, 11M, and 11K, respectively, via the belt 21 to form four primary transfer nips therebetween. An electrically biased, secondary transfer roller 25 is disposed opposite the transfer backup roller 26 via the belt 21 to form a secondary transfer nip therebetween. A belt cleaner 22 is disposed facing the belt support roller 28 via the belt 21 to remove residual toner from the belt 21 downstream from the secondary transfer nip.

Disposed below the transfer device 20 is a pair of registration rollers 44 for advancing the recording sheet P to the secondary transfer nip from the sheet feeding unit 4. An auxiliary pair of registration rollers 46 is also provided for advancing the recording sheet P from a manual feed tray 45 mounted to a side of the printing unit 3.

A sheet conveyance device 24 is also disposed below the transfer device 20, incorporating an endless conveyance belt entrained around multiple rollers to convey the recording sheet P from the secondary transfer nip to the fixing device 50. A pair of output rollers 47 is disposed adjacent to the fixing device 50 to form a nip there between, through which the recording sheet P is conveyed for output to an output sheet tray 48 outside the image forming apparatus 100.

Optionally, a duplex conveyance unit 32 may be disposed below the transfer device 20 and the fixing device 50 to reverse the recording sheet P after printing on the first side thereof for re-entry into the secondary transfer nip during duplex printing. A suitable sheet diverter may be provided adjacent to the fixing device 50 to selectively introduce the recording sheet P to the duplex conveyance unit 32 or to the output rollers 47.

The sheet feed unit 4 includes multiple input sheet trays 40 disposed in tiers, each accommodating a stack of recording sheets P, with a feed roller 42 disposed in contact with the uppermost one of the sheet stack to feed the recording sheets P one by one from the sheet tray 40. A sheet conveyance path 41 is defined by multiple pairs of conveyance rollers 43 and other suitable guide and conveyance members, along which the recording sheet P may be advanced toward the registration roller pair 44 in the printing unit 3.

The image forming apparatus 100 can perform printing in various print modes, including a duplex print mode or a simplex print mode, as well as a monochrome print mode or a full-color print mode, as specified by a user submitting a print job.

During operation, in each imaging station 10, the photoconductor drum 11 rotates counterclockwise in the drawing to forward its outer, photoconductive surface to a series of electrophotographic processes, including charging, exposure, development, transfer, and cleaning, in one rotation of the photoconductor drum 11.

First, the photoconductive surface is uniformly charged by the charging device 12 and subsequently exposed to the laser beam modulated and deflected through the exposure device 30. The laser exposure selectively dissipates the charge on the photoconductive surface to form an electrostatic latent image thereon according to image data representing a particular primary color. Then, the latent image enters the development device 13, which renders the incoming image visible using toner. The toner image thus obtained is forwarded to the primary transfer nip between the photoconductor 11 and the primary transfer roller 23.

At the primary transfer nip, the primary transfer roller 23 is supplied with a bias voltage of a polarity opposite that of the toner on the photoconductor 11. This electrostatically transfers the toner image from the photoconductive surface to an outer surface of the belt 21, with a certain small amount of residual toner particles left on the photoconductive surface. Such transfer process occurs sequentially at the four primary transfer nips along the belt travel path, so that toner images of different colors are superimposed one atop another to form a single multicolor image on the surface of the intermediate transfer belt 21.

After primary transfer, the photoconductive surface enters the cleaning device 14 to remove residual toner, and then to the discharging device to remove residual charges for completion of one imaging cycle. At the same time, the intermediate transfer belt 21 forwards the multicolor image to the secondary transfer nip between the transfer backup roller 26 and the secondary transfer roller 25.

Meanwhile, in the sheet feeding unit 4, the feed roller 42 rotates to introduce a recording sheet P from the sheet tray 40 toward the pair of registration rollers 44 being rotated. Alternatively, instead, a recording sheet P may be supplied from the manual feed tray 45 toward the pair of registration rollers 46 being rotated. Upon receiving the fed sheet P, the registration rollers stop rotation to hold the incoming sheet P therebetween, and then advance it in sync with the movement of the intermediate transfer belt 21 to the secondary transfer nip. At the secondary transfer nip, the multicolor image is transferred from the belt 21 to the recording sheet P, with a certain small amount of residual toner particles left on the belt surface.

After secondary transfer, the intermediate transfer belt 21 enters the belt cleaner 22, which removes residual toner from the intermediate transfer belt 21. At the same time, the recording sheet P bearing the powder toner image thereon is introduced into the fixing device 50, through which the multicolor image is fixed in place with heat and pressure.

Thereafter, the recording sheet P is advanced to between the pair of output rollers 47. Where simplex printing is intended (that is, printing is performed on one side of the recording sheet P), the output roller pair 47 forwards the recording sheet P to the output sheet tray 48 for stacking outside the apparatus 100. Where duplex printing is intended (that is, where printing is performed on both sides of the recording sheet P), the output roller pair 47 directs the recording sheet P to move backward and enter the duplex conveyance unit 32, which then reverses the incoming sheet P upside down to re-introduce it into the secondary transfer nip, such that a toner image is transferred and fixed on the second side of the recording sheet P, which eventually output to the output sheet tray 48 through the output roller pair 47.

It is to be noted that, although printing in the full-color print mode is described in the present embodiment, the image forming apparatus 100 may perform printing in the monochrome print mode. In such cases, image formation may be conducted using solely the black photoconductor 11K, with the intermediate transfer belt 21 moved away from the yellow, cyan, and magenta photoconductors 11Y, 11C, and 11M by displacing any of the belt-support rollers around which the intermediate transfer belt 21 is entrained (except the one that is equipped with a rotary driver).

Figure 2:
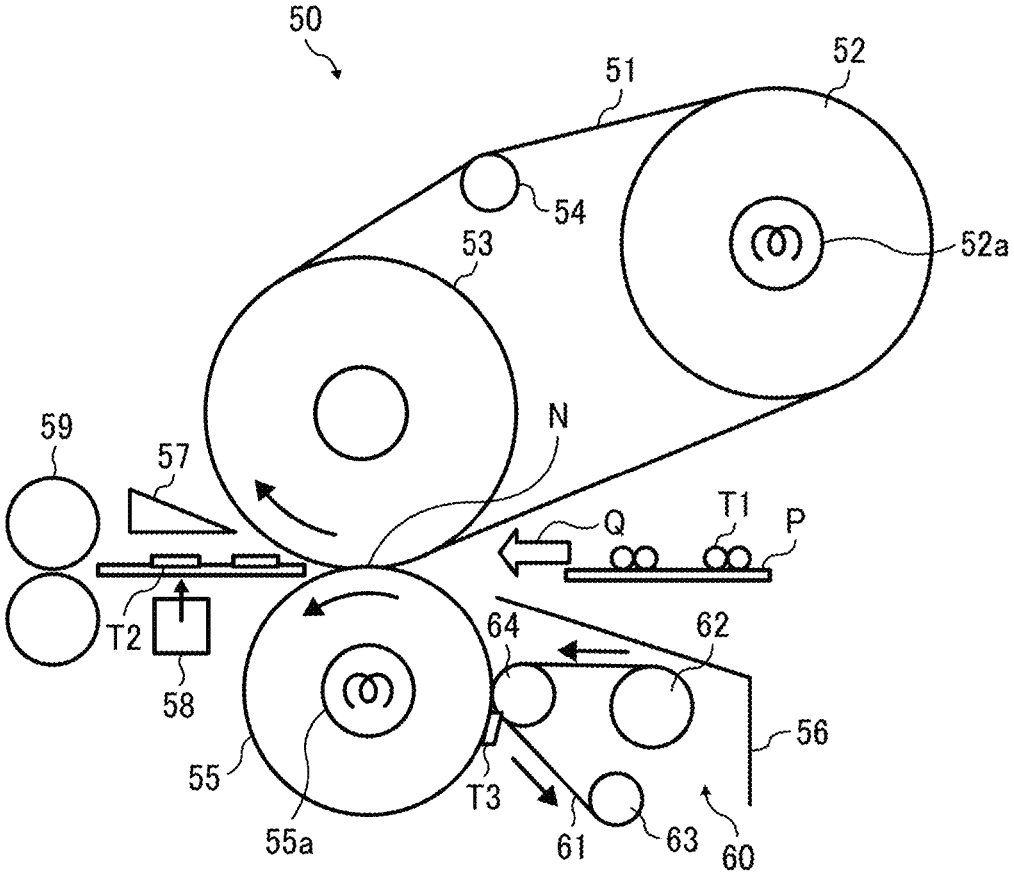
FIG. 2 is an end-on, axial cutaway view of a fixing device according to one or more embodiments of this patent specification.

FIG. 2 is an end-on, axial cutaway view of the fixing device 50 according to one or more embodiments of this patent specification.

As shown in FIG. 2, the fixing device 50 includes a rotary fuser member 51 subjected to heating, and a rotary pressure member 55 disposed opposite the fuser member 51. The fuser member 51 and the pressure member 55 are pressed against each other to form a fixing nip N therebetween, through which a recording medium P is conveyed in a conveyance direction Q to fix a toner image T thereon.

Specifically, in the present embodiment, the rotary fuser member 51 comprises an endless, fuser belt of suitable material entrained, under tension, around multiple rollers, including a heat roller 52, a fuser roller 53, and a tension roller 54. For example, the fuser belt 51 may be configured as an endless belt formed of a substrate of polyimide (PI) approximately 90 mm thick, upon which an anti-offset coating, such as perfluoroalkoxy (PFA), is deposited to prevent undesired adhesion of toner to the belt surface.

The heat roller 52 includes a heater 52*a* therein, which internally heats the heat roller 52 to in turn heat the rotary fuser belt 51 uniformly to a given operational temperature.

The fuser roller 53 may be configured as a cylindrical rubber roller. A rotary driver, such as a motor, may be connected to the fuser roller 53 via a gear or gear train to impart torque to the fuser roller 53 to in turn rotate the fuser belt 51 in a rotational direction clockwise in the drawing. The tension roller 54 may be configured as a tubular cylindrical member formed of aluminum, loaded with a spring or other tensioning device to maintain tension in the fuser belt 51.

The rotary pressure member 55 comprises a cylindrical pressure roller, disposed opposite the fuser roller 53 via the fuser belt 51. For example, the pressure roller 55 may be configured a cylindrical rubber roller. An auxiliary heater 55*a* may be disposed in the pressure roller 55, from which heat is imparted to heat the fuser belt 51 via the pressure roller 55.

A biasing mechanism is connected to the pressure roller 55 to press the roller 55 against the belt 51 generally toward the axial center of the fuser roller 53. The biasing mechanism of the pressure roller 55 may be configured to allow movement of the pressure roller 55 toward and away from the fuser belt 51 to selectively apply and release pressure across the fixing nip N.

Also included in the fixing device 50 are a sheet guide 56 disposed upstream from the fixing nip N in the conveyance direction Q to guide the recording sheet P into the fixing nip N, a sheet separator 57 disposed facing the fuser belt 51 at the exit of the fixing nip N to facilitate separation of the recording sheet P from the belt 51, and a pair of conveyance rollers 59 disposed downstream from the fixing nip N in the conveyance direction Q to direct the recording sheet P toward the output roller pair 47 outside the fixing device 50.

Additionally, a sheet sensor 58 may be disposed adjacent to the fixing nip N to detect whether the recording sheet P is conveyed in a timed manner through the fixing nip N. The sheet sensor 58 may be configured to output a detection signal when a leading or trailing edge of the recording sheet P is conveyed past the fixing nip N. Such a detection signal may be used to measure a distance between two consecutive recording sheets P successively conveyed through the fixing nip N.

During operation, the biasing mechanism presses the pressure roller 55 against the fuser roller 53 via the fuser belt 51 to establish the fixing nip N. As the fuser belt 51 and the pressure roller 55 rotate together, the recording sheet P, guided along the sheet guide 56, enters the fixing nip N.

At the fixing nip N, an unfixed, powder toner image T1 on the recording sheet P is molten and fused and then penetrates into the microscopic structure of the sheet P formed, for example, of cellulose fibers or the like, followed by solidification of molten toner to render the unfixed toner image T1 into a fixed toner image T2. At this point, heating the pressure roller 55 with the dedicated heater 55*a* allows for good anchoring of solidified toner to the recording sheet P.

After fixing, the recording sheet P exits the fixing nip N with the sheet separator 57 separating the sheet leading edge off the fuser belt 51, followed by the conveyor roller pair 59 forwarding the outgoing sheet P to outside the fixing device 50.

With continued reference to FIG. 2, the fixing device 50 is shown further including a cleaning system 60 disposed adjacent to the pressure member 55 to clean the pressure member 55, including a cleaning web 61 disposed in contact with the pressure member 55 to wipe the pressure member 55.

Provision of the cleaning system 60 effectively cleans the pressure member 55 of offset toner T3 (that is, undesired deposits of toner particles transferred from the recording medium P due to improper heating of the toner image T1 at the fixing nip N) and other adherent contaminants in the fixing device 50, which in turn allows for maintaining the fuser member 51 clean of soiling where offset toner constantly transfers from the fuser member 51 to the pressure member 55 through the fixing nip N.

Specifically, in the present embodiment, the cleaning web 61 comprises a sheet or strip of any suitable material, such as fabric, paper, resin sheet or film, foil, or the like, with its width, length, and thickness dimensioned to provide adequate cleaning of the pressure roller 55. A release agent may be provided where the cleaning web 61 contacts the pressure roller 55, such that the release agent is applied in a thin, uniform coat to the surface of the pressure roller 55 as the cleaning web 51 slides against the pressure roller 55.

For example, in the present embodiment, the cleaning web 61 is an elongated strip of nonwoven fabric, such as aromatic polyamide, impregnated with a release agent. Examples of release agent include silicone oil, and any suitable material that facilitates transfer of offset toner and other deposits from the pressure roller 55 to the cleaning web 61 while preventing abrasion on the surface of the pressure roller 55.

More specifically, the cleaning system 60 includes a supply roller 62 around which the cleaning web 61 is wound before use, a takeup roller 63 connected with a free, distal end of the cleaning web 61 to take up the cleaning web 61 after use, and a biasing roller 64 disposed between the supply roller 62 and the takeup roller 63 to press the cleaning web 61 against the pressure roller 55 to form a cleaning nip therebetween. The cleaning nip may extend, for example, approximately 3 to 6 mm in the circumferential direction of the pressure roller 55.

During operation, the cleaning web 61 is positioned to contact the pressure roller 55, while pressed from the biasing roller 64 against the pressure roller 55 at the cleaning nip. As the cleaning web 61 slides against the pressure roller 55 rotating in its rotational direction, friction between the cleaning web 61 and the pressure roller 55 causes offset toner T3 or other contaminants to transfer from the pressure roller 55 to the cleaning web 61, thereby cleaning the pressure roller 55.

Figure 3:
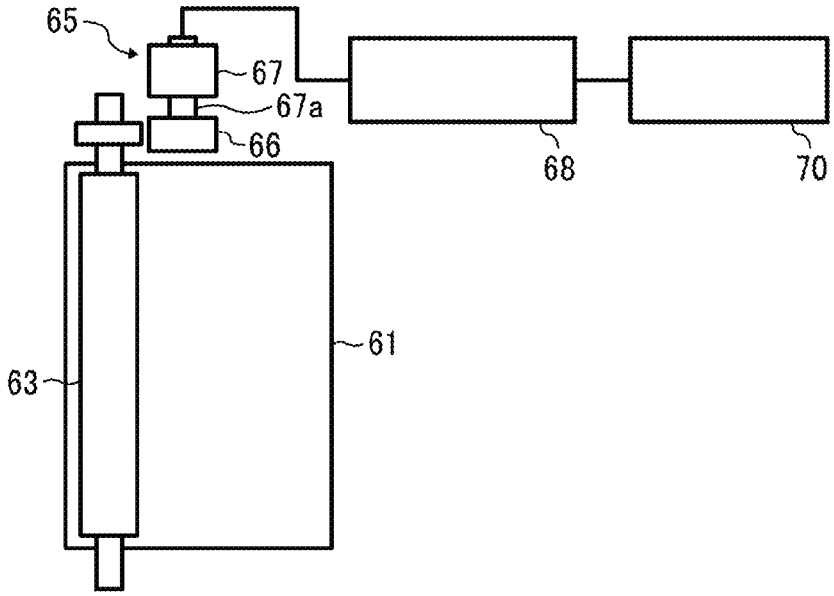
FIG. 3 is a schematic, bottom plan view of a cleaning system included in the fixing device of FIG. 2.

FIG. 3 is a schematic, bottom plan view of the cleaning system 60 included in the fixing device 50 of FIG. 2.

As shown in FIG. 3, the cleaning system 60 includes, in addition to the cleaning web 61, a web supply mechanism 65 operatively connected to the cleaning web 61 to supply a new, unused portion of the cleaning web 61 to the pressure member 55, and a controller 68 operatively connected to the web supply mechanism 65 to control a web supply amount by which the cleaning web 61 is supplied to the pressure member 55.

Provision of the web supply mechanism 65 allows for maintaining effective cleaning performance wherein supplying a new, unused portion of the cleaning web 61 to the pressure member 55 prevents escape of offset toner through a minute gap between the cleaning web 61 and the pressure member 55. Moreover, the capability to control cleaning web supply allows for reducing maintenance costs and efforts, while obviating an unnecessary, superfluous supply of cleaning web, which would otherwise result in a significant amount of waste material that is detrimental to the environment.

Specifically, in the present embodiment, the web supply mechanism 65 comprises a stepper motor 67 having its rotational axis 67*a* connected to a reduction gear 66 meshing a driven gear that engages a shaft of the takeup roller 63. The controller 68 may be configured as suitable electrical circuitry, such as a central processing unit (CPU) and its associated memory devices, connected to the stepper motor 67.

During operation, the controller 68 activates the stepper motor 67 to rotate in discrete steps for a specific activation time, whenever a given number of recording sheets P are processed through the fixing nip N. Torque generated by the stepper motor 67 is transmitted via the gears to the takeup roller 63, which then takes up the cleaning web 61 from the supply roller 62. Upon lapse of the activation time, the controller 68 deactivates the stepper motor 67 until an interval time elapses to again activate the stepper motor 67.

The amount by which the cleaning web 61 is supplied to the pressure roller 55 may be controlled, for example, by adjusting the period of activation time during which the stepper motor 67 is activated to rotate the takeup roller 63. The amount by which the cleaning web 61 is unreeled per each step of the motor 67 may be set to, for example, 0.82 mm, through appropriate adjustment of a reduction ratio of the gear train. The period of interval time during which the stepper motor 67 is deactivated may be set to, for example, 15 seconds.

The inventors have recognized that one problem associated with the cleaning system in which the cleaning web is applied to the pressure member, as opposed to the fuser member, is that a soiling rate, that is, an amount of offset toner and other contaminants collected on the cleaning web, can change occasionally depending on several factors, making it difficult to supply an appropriate amount of cleaning web to the pressure member constantly and effectively.

One factor responsible for occasional changes in the soiling rate of the cleaning web is a circumferential, rotational distance travelled by the pressure member in direct contact with the fuser member.

Generally, the amount of offset toner collected on the cleaning web increases as the pressure member rotates in direct contact with the fuser member because offset toner transfers from the fuser member to the pressure member, and eventually to the cleaning web, where the pressure member and the fuser member contact each other directly, that is, without a recording sheet intervening therebetween. Consequently, the shorter the distance traveled per unit time by the pressure member in direct contact with the fuser member, the higher the soiling rate of the cleaning web, and the longer the distance traveled per unit time by the pressure member in direct contact with the fuser member, the lower the soiling rate of the cleaning web.

Another factor influencing the soiling rate of the cleaning web is different modes of operation in which image formation is executed.

For example, the amount of offset toner collected on the cleaning web increases where image formation is executed in duplex print mode. In duplex printing where the recording medium passes through the fixing nip twice for printing toner images on both sides thereof, a certain amount of toner once fixed on the first printed side of the recording medium can transfer to the pressure member during the second pass of the recording medium, resulting in a relatively large amount of offset toner collected on the cleaning web.

This is particularly true where duplex printing is performed in an interleave mode, where a plurality of recording media are collectively conveyed after their first pass through the fixing nip, turned upside down, and then re-introduced into the fixing nip, resulting in an interval time from completion of the first pass and start of the second pass during which the pressure member travels in direct contact with the fuser member, which typically amounts to a longer period of time than that required where a single recording medium passes through the fixing nip during simplex printing.

Still another factor influencing the soiling rate of the cleaning web is occurrence of isolated pixels in image data from which the toner image is produced.

In digital electrophotographic printing, image data from which a toner image is produced may contain black, foreground pixels that are to be colored with toner particles and surrounded by white, background pixels that are not to be colored. When printed on the recording medium, these isolated pixels are converted into small separate dots of toner spaced apart from each other. These toner dots tend to exhibit a weaker adhesion to the recording medium than a larger, solid or linear image area, resulting in greater amounts of offset toner, which are eventually collected on the cleaning web.

Experiments have been conducted to investigate effects of isolated pixels occurring in original image data on the amount of offset toner collected on the cleaning web. In the experiment, images composed of halftone dot patterns with different densities were printed using a fixing device equipped with a cleaning web applied to a rotary pressure member. After printing, the cleaning web was examined to measure a soiling rate at which the cleaning web is covered with offset toner removed from the pressure member.

Figure 4:
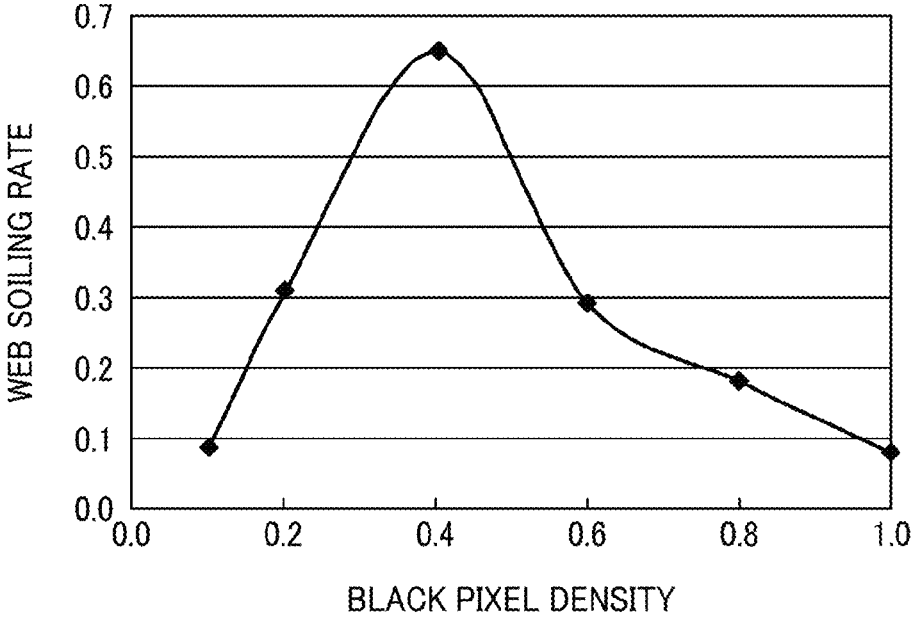
FIG. 4 is a graph showing results of experiments.

FIG. 4 is a graph showing results of the experiments, wherein a soiling rate of the cleaning web, measured as a density of toner deposited on the cleaning web, is plotted against a black pixel density, measured as a proportion of black, foreground pixels in the original image data.

As shown in FIG. 4, the soiling rate of the cleaning web is not directly proportional to the black pixel density. That is, the soiling rate increases with increasing black pixel density where the black pixel density is relatively low, and decreases with increasing black pixel density where the black pixel density is relatively high. A maximum soiling rate is reached where the black pixel density is within a moderate range between 0.35 and 0.45. Assuming that each foreground pixel remains isolated from each other where the black pixel density is below 0.6, the soiling rate is maximized where a coverage at which the image data is covered with isolated pixels is in a range higher than 35% and equal to or smaller than 45%.

Several reasons may account for the non-directly proportional relation between the soiling rate of the cleaning web and the black pixel density.

In general, toner particles deposited with a relatively high black pixel density tend to connect with each other to create a large continuous layer when fused under heat and pressure at the fixing nip. By contrast, toner particles deposited with a relatively low black pixel density tend to create small dots on the recording medium, which remain separated from each other when fused under heat and pressure at the fixing nip. Of these, toner in the form of a large continuous layer exhibits a stronger adhesion to, and hence a smaller offset from, the recording medium than does toner in the form of small separate dots, as the former exhibits a relatively large amount of connection between toner particles, which stabilizes connection to the recording medium.

Thus, rather than the black pixel density itself, the soiling rate or the amount of offset toner collected on the cleaning web depends more directly on the amount of small separate toner dots on the recording medium, which in turn depends on the occurrence rate of isolated pixels in the image data from which the toner image is produced.

In the halftone image pattern used in the experiments, the amount of small separate toner dots increases as the black pixel density increases from 0%, reaches a maximum level with the black pixel density of approximately 40%, and then decreases as the black pixel density exceeds 40%. Although a substantial level of separation between toner dots may be maintained as long as the black pixel density does not exceed 60%, the amount of small separate toner dots falls sharply where the black pixel density exceeds 60%, and eventually reaches 0% as the black pixel density reaches 100%.

Note that correlation between the amount of small separate toner dots and the black pixel density described above is consistent with correlation between the soiling rate of the cleaning web and the black pixel density depicted in FIG. 4. The specific ranges and values of black pixel density associated with the amount of small separate toner dots and the soiling rate of the cleaning web may vary depending on specific applications of the image forming apparatus.

Hence, the soiling rate of the cleaning web can change occasionally depending on various operational conditions, including the rotational distance traveled by the pressure member in direct contact with the fuser member, the mode of operation of the image forming apparatus, and the occurrence rate of isolated pixels in image data from which the toner image is produced. Failure to adjust the supply of cleaning web according to the soiling rate of the cleaning web would cause adverse consequences, such as unnecessary, superfluous supply of the cleaning web, or escape of offset toner through a minute gap between the cleaning web and the pressure member.

To counteract these and other problems, the fixing device 50 incorporating the cleaning system according to this patent specification can control a web supply amount by which the cleaning web 61 is supplied to the pressure member 55 depending on one or more operational conditions.

Specifically, the controller 68 adjusts the web supply amount depending on at least one of a circumferential, rotational distance traveled by the pressure roller 55 in direct contact with the fuser belt 51, or an occurrence rate of isolated pixels in image data from which the toner image is produced.

As used herein, the term "isolated pixel" or "isolated pixels" is used to describe an individual black, foreground pixel, or a small cluster of such pixels, that are to be colored with toner particles at a sufficient image density and surrounded by white, background pixels that are not to be colored. For example, a single foreground pixel located at a center of an array of three-by-three pixels and surrounded by eight background pixels is identified as an isolated pixel.

The size of a pixel cluster that is identified as isolated pixels may vary depending on pixel density or resolution of image data, such as, for example, two-by-two pixels or smaller for image data with a pixel density of 1,200 dots per inch (dpi). Where the pixel density of image data is sufficiently high, a three-by-three array of foreground pixels encircled entirely by sixteen background pixels may be all identified as isolated pixels.

Adjustment of the web supply amount depending on one or more operational conditions allows for effectively adjusting the supply of cleaning web according to the soiling rate of the cleaning web 61, leading to effective performance of the cleaning system 60 which is exempted from unnecessary, superfluous supply of the cleaning web, or escape of offset toner through a minute gap between the cleaning web and the pressure member.

Specifically, in the present embodiment, the controller 68 may increase the web supply amount where the rotational distance traveled by the pressure roller 55 in direct contact with the fuser belt 51 increases, and decreases the web supply amount where the rotational distance traveled by the pressure roller 55 in direct contact with the fuser belt 51 decreases.

Such arrangement ensures that the web supply control effectively prevents unnecessary, superfluous supply of the cleaning web, or escape of offset toner through a minute gap between the cleaning web and the pressure member, because the distance traveled by the pressure roller 55 in direct contact with the fuser roller 51 reliably reflects the soiling rate or the amount of offset toner collected on the pressure roller 55.

Further, in the present embodiment, the controller 68 may calculate the rotational distance traveled by the pressure roller 55 in direct contact with the fuser belt 51 based on a length of the recording sheet P in the conveyance direction Q and a pickup cycle representing an interval time between which two consecutive recording sheets P are sequentially processed through the fixing nip N. In such cases, the distance traveled by the pressure roller 55 in direct contact with the fuser roller 51 may be calculated as an interval distance between two adjacent edges of the consecutive recording sheets P.

Alternatively, instead, the controller 68 may calculate the rotational distance traveled by the pressure roller 55 in direct contact with the fuser belt 51 based on a length of the recording sheet P in the conveyance direction Q and the detection signal from the sensor 58 (see FIG. 2) a distance between two consecutive recording sheets P sequentially passes through the fixing nip N. In such cases, the distance traveled by the pressure roller 55 in direct contact with the fuser roller 51 may be calculated as an interval distance between two adjacent edges of the consecutive recording sheets P.

Figure 5:
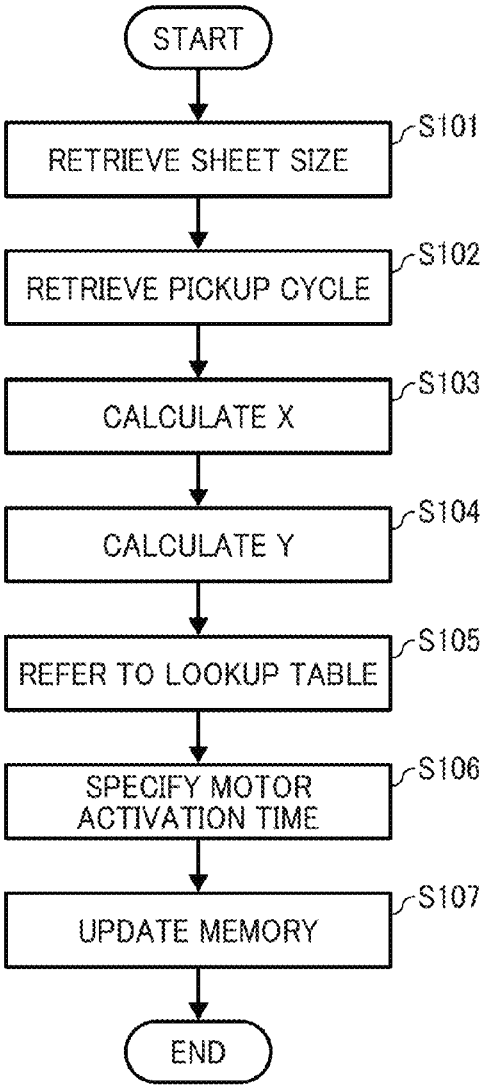
FIG. 5 is a flowchart illustrating web supply control in the fixing device according to one embodiment of this patent specification.

FIG. 5 is a flowchart illustrating web supply control in the fixing device 50 according to one embodiment of this patent specification, wherein the controller 68 adjusts the web supply amount depending on the rotational distance traveled by the pressure roller 55 in direct contact with the fuser belt 51.

As shown in FIG. 5, to print or duplicate an image on a recording sheet P, the controller 68 retrieves a length of the recording sheet P in the conveyance direction Q (step S101), as well as a pickup cycle of the recording sheet P, representing an interval time between which two consecutive recording sheets P are sequentially processed through the fixing nip N (step S102).

Then, the controller 68 calculates an interval distance X between two adjacent edges of the consecutive recording sheets P, that is, a rotational distance traveled per page by the pressure roller 55 in direct contact with the fuser belt 51 (step S103). Calculation of the distance X may be performed, for example, using the following equation:

$$X=C*V-L \qquad \text{Equation 1}$$

where "X" denotes the edge-to-edge interval distance between the recording sheets P, "C" denotes the pickup cycle of the recording sheet P, "V" denotes a linear speed at which the recording sheet P is conveyed through the fixing nip N, and "L" denotes the length of the recording sheet P in the conveyance direction Q.

Then, the controller 68 calculates a cumulative interval distance Y between two adjacent edges of the consecutive recording sheets P accumulated in one minute, that is, a rotational distance traveled per minute by the pressure roller 55 in direct contact with the fuser belt 51 (step S104). Calculation of the distance Y may be performed, for example, using the following equation:

$$Y=(N-1)*X \qquad \text{Equation 2}$$

where "Y" denotes the cumulative edge-to-edge interval distance between the recording sheets P, "N" denotes the number of recording sheets P processed per minute in the fixing device 50, and "X" denotes the edge-to-edge interval distance between the recording sheets P.

Table 1 below provides exemplary values of distances X and Y calculated for different types of recording sheets P with different pickup cycles and different lengths in the conveyance direction Q.

TABLE 1

| | Sheet size | | | | | |
|---|---|---|---|---|---|---|
| | B5-width | A4-width | A3-height | Letter-width with +0.1 tolerance | A4-height with +0.1 tolerance | B4-height with +0.1 tolerance |
| Pickup cycle C (msec) | 664 | 664 | 1168 | 852 | 996 | 1168 |
| Length in conveyance direction L (mm) | 182 | 210 | 420 | 216 | 297.1 | 364.1 |
| Interval distance X (mm) | 110.1 | 82.1 | 93.8 | 158.8 | 141.1 | 149.7 |
| Cumulative interval distance Y (mm) | 9800.1 | 7308.1 | 4691.9 | 10958.6 | 8323.1 | 7486.9 |

Then, after calculating the distance Y, the controller 68 refers to a lookup table, which associates a specific range of rotational distance traveled per minute by the pressure roller 55 in direct contact with the fuser belt 51 with an optimal period of activation time during which the stepper motor 67 is activated to supply a corresponding amount of cleaning web to the pressure roller 55 (step S105). Table 2 below is an example of such a lookup table.

TABLE 2

| Cumulative interval distance Y (mm) | Motor activation time (sec) |
|---|---|
| Y ≤ 4600 | 5 (default) |
| 4600 < Y ≤ 6000 | 6 |
| 6000 < Y ≤ 8000 | 7 |
| 8000 < Y ≤ 10000 | 8 |
| 10000 < Y | 9 |

According to the lookup table, the controller 68 specifies a specific activation time with which to drive the stepper motor 67 (step S106). Then, the controller 68 updates the memory with the specified activation time (step S107). By activating the stepper motor 67 according to the activation time thus specified, the cleaning system 60 can optimize the supply of cleaning web to the pressure roller 55.

Figure 6:
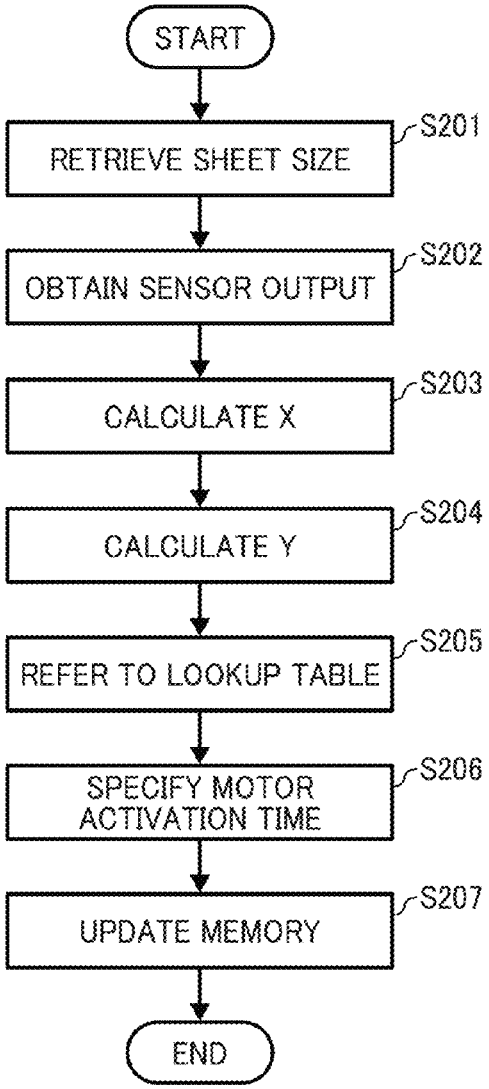
FIG. 6 is a flowchart illustrating web supply control in the fixing device according to another embodiment of this patent specification.

FIG. 6 is a flowchart illustrating web supply control in the fixing device 50 according to another embodiment of this patent specification, wherein the controller 68 adjusts the web supply amount depending on the rotational distance traveled by the pressure roller 55 in direct contact with the fuser belt 51.

As shown in FIG. 6, to print or duplicate an image on a recording sheet P, the controller 68 retrieves a length of the recording sheet P in the conveyance direction Q (step S201), and obtains a detection signal output from the sensor 58, indicating a distance between two consecutive recording sheets P sequentially passes through the fixing nip N (step S202).

Then, the controller 68 calculates an interval distance X between two adjacent edges of the consecutive recording sheets P, that is, a rotational distance traveled per page by the pressure roller 55 in direct contact with the fuser belt 51 (step S203).

Then, the controller 68 calculates a cumulative interval distance Y between two adjacent edges of the consecutive recording sheets P accumulated in one minute, that is, a rotational distance traveled per minute by the pressure roller 55 in direct contact with the fuser belt 51 (step S204).

Then, after calculating the distance Y, the controller 68 refers to a lookup table (such as one shown in Table 2), which associates a specific range of rotational distance traveled per minute by the pressure roller 55 in direct contact with the fuser belt 51 with an optimal period of activation time during which the stepper motor 67 is activated to supply a corresponding amount of cleaning web to the pressure roller 55 (step S205).

According to the lookup table, the controller 68 specifies a specific activation time with which to drive the stepper motor 67 (step S206). Then, the controller 68 updates the memory with the specified activation time (step S207). By activating the stepper motor 67 according to the activation time thus specified, the cleaning system 60 can optimize the supply of cleaning web to the pressure roller 55.

In further embodiment, the controller 68 identifies an isolated pixel area where at least one isolated pixel is present in the image data, and calculates the occurrence rate of isolated pixels based on a coverage A at which the isolated pixel area is covered with isolated pixels, and a length B to which the isolated pixel area extends in a direction corresponding to the conveyance direction Q of the recording sheet P.

Such arrangement ensures that the web supply control effectively prevents unnecessary, superfluous supply of the cleaning web, or escape of offset toner through a minute gap between the cleaning web and the pressure member, because the occurrence rate of isolated pixels, calculated based on the coverage A and the length B of the isolated pixel area, reliably reflects the soiling rate or the amount of offset toner collected on the pressure roller 55.

With continued reference to FIG. 3, the cleaning system in the present embodiment is shown further including an image data analyzer 70 operatively connected to the controller 68. For example, the image data analyzer 70 may be incorporated in the scanning unit of the image forming apparatus 100 that analyzes image data acquired, for example, through scanning of an original image or transmitted from an external data source upon printing or photocopying.

The image data analyzer 70 includes an arithmetic function that calculates the coverage A and the length B of the isolated pixel area, based on which the occurrence rate of isolated pixels in the image data may be determined. Calculation of these parameters A and B may be accomplished, for example, based on size of each single pixel dictated by the resolution of the image forming apparatus, as well as position of each pixel and an interval between adjacent pixels.

The image data analyzed by the image data analyzer 70 is forwarded to the controller 68, which then detect presence or absence of isolated pixels to identify an isolated pixel area in the image data, and adjusts the amount of web supply based on the coverage A and the length B of the isolated pixel area.

Figure 7:
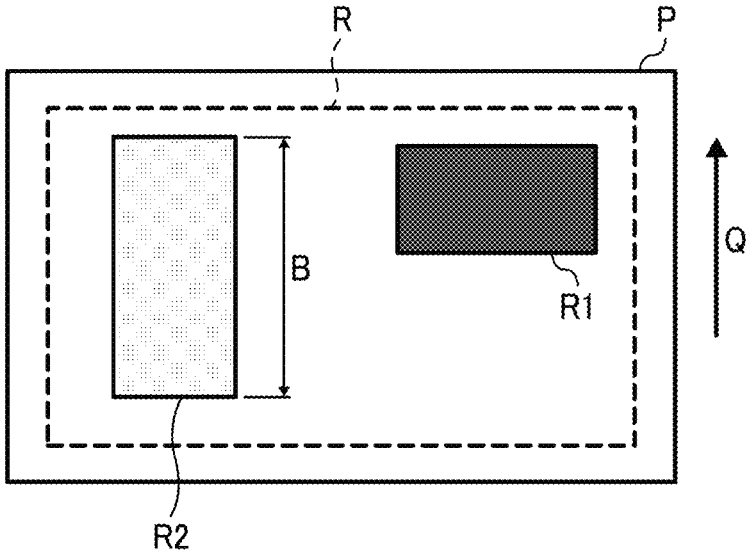
FIG. 7 is a schematic view of a recording medium on which a toner image is produced.

FIG. 7 is a schematic view of a recording sheet P on which a toner image having a specific image area R is produced.

As shown in FIG. 7, the image area R may contain a solid image area R1 formed from foreground pixels each of which connects with each other, and a dotted, non-solid image area R2 (e.g., halftone) formed from foreground pixels or small clusters of foreground pixels each of which is spaced apart from each other.

In this case, the dotted image area R2 corresponds to the isolated pixel area of image data from which the toner image is produced. The coverage A of the isolated pixel area represents the amount or extent to which the dotted image area R2 is covered with toner, and the length B of the isolated pixel area represents the distance between opposed extremities of the dotted image area R2 in the conveyance direction Q of the recording sheet P.

Further, in the present embodiment, the controller 58 may maximize the web supply amount where the coverage A of the isolated pixel area is higher than 35% and equal to or lower than 45%.

Such arrangement ensures that a sufficient amount of cleaning web is supplied to the pressure roller 55 to prevent escape of offset toner from a minute gap between the cleaning web 61 and the pressure roller 55 in a configuration in which the soiling rate is maximized where the isolated pixel coverage is in a range higher than 35% and equal to or smaller than 45% (see FIG. 4). It is to be noted that, although a particular range of isolated pixel coverage is described, the range of the coverage A for which the web supply amount is maximized may be set differently depending on specific applications of the image forming apparatus.

Figure 8:
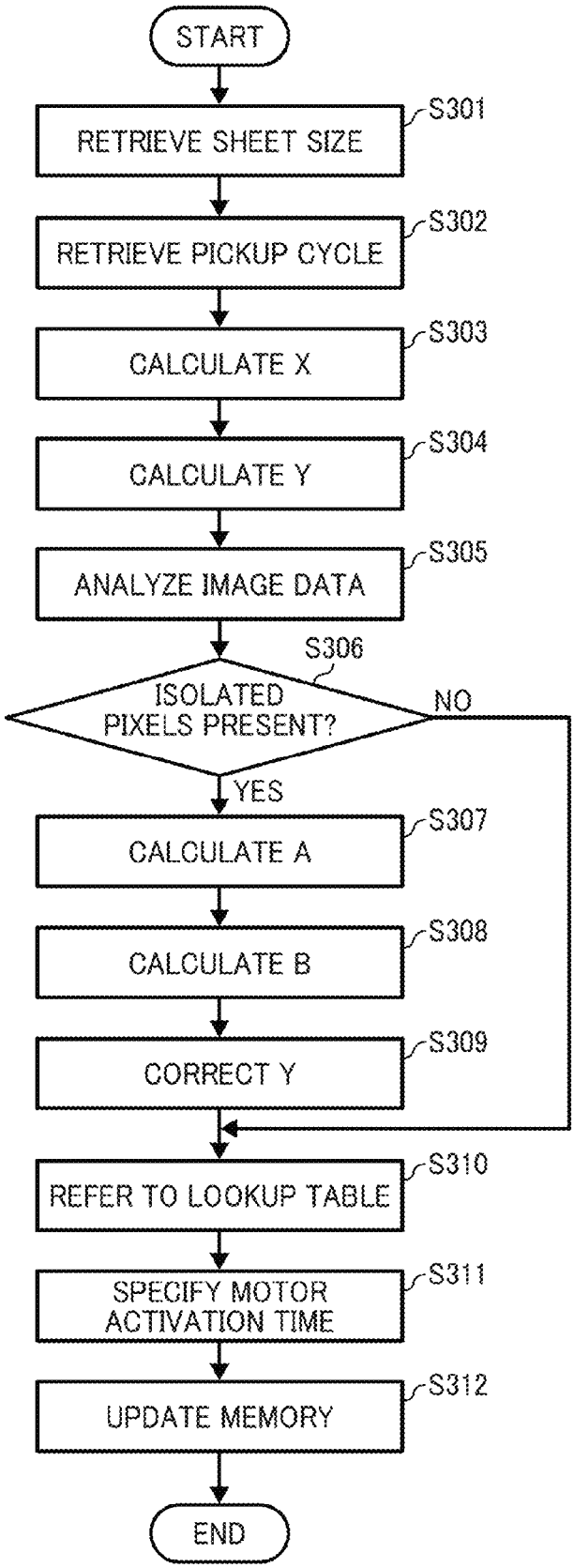
FIG. 8 is a flowchart illustrating web supply control in the fixing device according to still another embodiment of this patent specification.

FIG. 8 is a flowchart illustrating web supply control in the fixing device 50 according to still another embodiment of this patent specification, wherein the controller 68 adjusts the web supply amount depending on the rotational distance traveled by the pressure roller 55 in direct contact with the fuser belt 51 and the occurrence rate of isolated pixels in image data from which the toner image is produced.

As shown in FIG. 8, to print or duplicate an image on a recording sheet P, the controller 68 retrieves a length of the recording sheet P in the conveyance direction Q (step S301).

The controller 68 also retrieves a pickup cycle of the recording sheet P, representing an interval time between which two consecutive recording sheets P are sequentially processed through the fixing nip N (step S302). Alternatively, instead of retrieving the pickup cycle, the controller 68 may obtain the output signal from the sheet sensor 58, indicating, indicating a distance between two consecutive recording sheets P sequentially passes through the fixing nip N.

Then, the controller 68 calculates an interval distance X between two adjacent edges of the consecutive recording sheets P, that is, a rotational distance traveled per page by the pressure roller 55 in direct contact with the fuser belt 51 (step S303).

Then, the controller 68 calculates a cumulative interval distance Y between two adjacent edges of the consecutive recording sheets P accumulated in one minute, that is, a rotational distance traveled per minute by the pressure roller 55 in direct contact with the fuser belt 51 (step S304).

Meanwhile, the controller 68 directs the image data analyzer 70 to analyze image data from which a toner image is reproduced (step S305), and determines whether an isolated pixel is present in the image data (step S306).

Where no isolated pixel is present in the image data ("NO" in step S306), the operation proceeds to step S310.

Where one or more isolated pixels are present in the image data ("YES" in step S306), the controller 68 identifies an isolated image area and directs the image data analyzer 70 to calculate a coverage A of the isolated image area (step S307) as well as a length B of the isolated image area (step S308).

Then, the controller 68 corrects the distance Y based on the coverage A and the length B of the isolated image area (step S309). Such correction may be performed, for example, by multiplying the original distance Y by a correction coefficient K corresponding to the coverage A, and by a ratio between the length B and an entire length of the recording sheet P in the conveyance direction Q, as given by the following equation:

$$Yc=K*B/L*Y \qquad \text{Equation 3}$$

where "Yc" denotes the corrected distance traveled by the pressure roller 55 in direct contact with the fuser belt 51, "K" denotes the correction coefficient corresponding to the coverage A, "L" denotes the entire length of the recording sheet P in the conveyance direction Q, and "Y" denotes the original distance.

The controller 58 may determine a specific correction coefficient K using a lookup table, which associates a specific range of coverage A with a corresponding correction coefficient K. For example, the correction coefficient K may be set to 1 for a coverage A equal to or greater than 0.6, and to a suitable value exceeding 1 for a coverage A smaller than 0.6. Table 3 below is an example of such a lookup table.

TABLE 3

| Coverage A | Correction coefficient K |
|---|---|
| $A < 0.2$ | 1.2 |
| $0.2 \leq A \leq 0.35$ | 1.5 |
| $0.35 < A \leq 0.45$ | 2 |
| $0.45 < A < 0.6$ | 1.5 |
| $0.6 \leq A < 0.8$ | 1 |
| $0.8 \leq A$ | 1 |

Then, after calculating the distance Y or Yc, the controller 68 refers to a lookup table (such as one shown in Table 2), which associates a specific range of rotational distance traveled per minute by the pressure roller 55 in direct contact with the fuser belt 51 with an optimal period of activation time during which the stepper motor 67 is activated to supply a corresponding amount of cleaning web to the pressure roller 55 (step S310).

According to the lookup table, the controller 68 specifies a specific activation time with which to drive the stepper motor 67 (step S311). Then, the controller 68 updates the memory with the specified activation time (step S312). By activating the stepper motor 67 according to the activation time thus specified, the cleaning system 60 can optimize the supply of cleaning web to the pressure roller 55.

Although in several embodiments depicted above, the fixing device is depicted as a belt-based assembly formed of an endless, looped fuser belt 51 entrained around multiple rollers 52, 53, and 54 with a pressure roller 55 disposed opposite the roller 53 via the belt 51, alternatively, instead, the fixing device according to this patent specification may be applicable to any type of imaging system that includes a pair of opposed fixing members disposed opposite to each other to form a nip therebetween. For example, the fixing device may be configured as a roller-based assembly that employs an internally heated fuser roller with a pressure member disposed opposite the fuser roller.

Further, heaters employed in the fixing assembly may be of any heating element, such as a halogen heater, an electromagnetic induction heater, a resistive heater, a carbon heater, or the like. For example, instead of using the heat roller 52 provided with the internal heater 52*a* around which the fuser belt 51 is entrained, the fuser belt 51 may be configured as a self-heating belt in which a heating element is integrally embedded.

Also, the image forming apparatus incorporating the fixing device may be configured otherwise than depicted herein. For example, the printer section may employ any number of imaging stations or primary colors associated therewith, e.g., a full-color process with three primary colors, a bi-color process with two primary colors, or a monochrome process with a single primary color. Further, instead of a tandem printing system, the printing section may employ any suitable imaging process for producing a toner image on a recording medium such as one that employs a single photoconductor surrounded by multiple development devices for different primary colors, or one that employs a photoconductor in conjunction with a rotary or revolver development system rotatable relative to the photoconductive surface.

Furthermore, the image forming apparatus according to this patent specification may be applicable to any type of electrophotographic imaging systems, such as photocopiers, printers, facsimiles, and multifunctional machines incorporating several of such imaging functions.

To recapitulate, the fixing device 50 according to several embodiments of this patent specification includes a rotary fuser member 51, such as an endless, looped belt, subjected to heating, and a rotary pressure member 55, such as a cylindrical roller, opposite the fuser member 51. The fuser member 51 and the pressure member 55 are pressed against each other to form a fixing nip N therebetween through which a recording medium P, such as a sheet of paper, is conveyed in a conveyance direction Q to fix a toner image T thereon.

The fixing device 50 also includes a cleaning system 60 disposed adjacent to the pressure member 55 to clean the pressure member 55. The cleaning system 60 includes a cleaning web 61, such as a sheet of fabric, disposed in contact with the pressure member 55 to wipe the pressure member 55; a web supply mechanism 65 operatively connected to the cleaning web 61 to supply a new, unused portion of the cleaning web 61 to the pressure member 55; and a controller 68 operatively connected to the web supply mechanism 65 to control a web supply amount by which the cleaning web 61 is supplied to the pressure member 55.

The controller 68 adjusts the web supply amount depending one or more operational conditions, including at least one of a circumferential, rotational distance traveled by the pressure member 55 in direct contact with the fuser member 51, or an occurrence rate of isolated pixels in image data from which the toner image T is produced.

Adjustment of the web supply amount depending on one or more operational conditions allows for effectively adjusting the supply of cleaning web according to the soiling rate of the cleaning web 61, leading to effective performance of the cleaning system 60 which is exempted from unnecessary, superfluous supply of the cleaning web, or escape of offset toner through a minute gap between the cleaning web and the pressure member.

In one embodiment, the controller 68 may increase the web supply amount where the rotational distance traveled by the pressure member 55 in direct contact with the fuser member 51 increases, and decreases the web supply amount where the rotational distance traveled by the pressure member 55 in direct contact with the fuser member 51 decreases.

Such arrangement ensures that the web supply control effectively prevents unnecessary, superfluous supply of the cleaning web, or escape of offset toner through a minute gap between the cleaning web and the pressure member, because the distance traveled by the pressure member 55 in direct contact with the fuser belt 51 reliably reflects the soiling rate or the amount of offset toner collected on the pressure member 55.

In further embodiment, the controller 68 may calculate the rotational distance traveled by the pressure member 55 in direct contact with the fuser member 51 based on a length of the recording medium P in the conveyance direction Q and a pickup cycle representing an interval time between which two consecutive recording sheets P are sequentially processed through the fixing nip N.

In such cases, the distance traveled by the pressure member 55 in direct contact with the fuser belt 51 may be calculated as an interval distance between two adjacent edges of the consecutive recording media P.

In still further embodiment, the fixing device 50 further includes a sensor 58, such as a sheet sensor, operatively connected with the controller 68 and disposed adjacent to the fixing nip N to output a detection signal when a leading or trailing edge of the recording medium P is conveyed past the fixing nip N. The controller 68 may calculate the rotational distance traveled by the pressure member 55 in direct contact with the fuser member 51 based on a length of the recording medium P in the conveyance direction Q and the detection signal from the sensor 58 indicating a distance between two consecutive recording media P sequentially passes through the fixing nip N.

In such cases, the distance traveled by the pressure member 55 in direct contact with the fuser belt 51 may be calculated as an interval distance between two adjacent edges of the consecutive recording media P.

In yet still further embodiment, the controller 68 may identify an isolated pixel area where at least one isolated pixel is present in the image data, and calculates the occurrence rate of isolated pixels based on a coverage A at which the isolated pixel area is covered with isolated pixels, and a length B to which the isolated pixel area extends in a direction corresponding to the conveyance direction Q of the recording medium P.

Such arrangement ensures that the web supply control effectively prevents unnecessary, superfluous supply of the cleaning web, or escape of offset toner through a minute gap between the cleaning web and the pressure member, because the occurrence rate of isolated pixels, calculated based on the coverage A and the length B of the isolated pixel area, reliably reflects the soiling rate or the amount of offset toner collected on the pressure member 55.

In yet still further embodiment, the controller 68 may maximize the web supply amount where the coverage A of the isolated pixel area is higher than 35% and equal to or lower than 45%.

Such arrangement ensures that a sufficient amount of cleaning web is supplied to the pressure member 55 to prevent escape of offset toner from a minute gap between the cleaning web 61 and the pressure member 55.

The fixing device 50 may be incorporated in an image forming apparatus 100, such as a photocopier, facsimile machine, printer, plotter, or multifunctional machine incorporating several of these features, including a printing unit 3 for producing a toner image on a recording medium P from image data. Effective cleaning of the rotary pressure member 55, which is exempted from unnecessary, superfluous supply of the cleaning web, or escape of offset toner through a minute gap between the cleaning web and the pressure member, and other beneficial effects may be obtained owing to incorporation of the fixing device 50.

Numerous additional modifications and variations are possible in light of the above teachings. It is therefore to be understood that, within the scope of the appended claims, the disclosure of this patent specification may be practiced otherwise than as specifically described herein.

What is claimed is:

1. A fixing device comprising:

a rotary fuser member subjected to heating;

a rotary pressure member opposite the fuser member, the fuser member and the pressure member being pressed against each other to form a fixing nip therebetween, through which a recording medium is conveyed in a conveyance direction to fix a toner image thereon; and a cleaning system disposed adjacent to the pressure member to clean the pressure member, the cleaning system including:

a cleaning web disposed in contact with the pressure member to wipe the pressure member;

a web supply mechanism operatively connected to the cleaning web to supply a new, unused portion of the cleaning web to the pressure member; and a controller operatively connected to the web supply mechanism to control a web supply amount by which the cleaning web is supplied to the pressure member, wherein the controller adjusts the web supply amount depending on a circumferential, rotational distance traveled by the pressure member in direct contact with the fuser member, and an occurrence rate of isolated pixels in image data from which the toner image is produced.

2. The fixing device according to claim 1, wherein the controller increases the web supply amount where the rotational distance traveled by the pressure member in direct contact with the fuser member increases, and decreases the web supply amount where the rotational distance traveled by the pressure member in direct contact with the fuser member decreases.

3. The fixing device according to claim 1, wherein the controller calculates the rotational distance traveled by the pressure member in direct contact with the fuser member based on a length of the recording medium in the conveyance direction and a pickup cycle representing an interval time between which two consecutive recording sheets are sequentially processed through the fixing nip.

4. The fixing device according to claim 1, further comprising:

a sensor operatively connected with the controller and disposed adjacent to the fixing nip to output a detection signal when a leading or trailing edge of the recording medium is conveyed past the fixing nip, wherein the controller calculates the rotational distance traveled by the pressure member in direct contact with the fuser member based on a length of the recording medium in the conveyance direction and the detection signal from the sensor indicating a distance between two consecutive recording media sequentially passes through the fixing nip.

5. The fixing device according to claim 1, wherein the controller identifies an isolated pixel area where at least one isolated pixel is present in the image data, and calculates the occurrence rate of isolated pixels based on a coverage at which the isolated pixel area is covered with isolated pixels, and a length to which the isolated pixel area extends in a direction corresponding to the conveyance direction of the recording medium.

6. The fixing device according to claim 1, wherein the controller maximizes the web supply amount where the coverage of the isolated pixel area is higher than 35% and equal to or lower than 45%.

7. An image forming apparatus incorporating the fixing device according to claim 1.

8. A method for controlling a web supply amount by which a cleaning web is supplied to a rotary pressure member pressed against a rotary fuser member to form a fixing nip therebetween through which a recording medium is conveyed to fix a toner image thereon, the method comprising:

determining a circumferential, rotational distance traveled by the pressure member in direct contact with the fuser member;

determining an occurrence rate of isolated pixels in image data from which the toner image is produced; and adjusting the web supply amount depending on the rotational distance traveled by the pressure member in direct contact with the fuser member, and the occurrence rate of isolated pixels.

* * * * *